US009044666B2

(12) United States Patent
Cameron

(10) Patent No.: US 9,044,666 B2
(45) Date of Patent: Jun. 2, 2015

(54) CUE BALL DEFLECTIONS PATH TEACHING AID AND METHOD

(76) Inventor: Chris Cameron, Renton, WA (US)

( * ) Notice: Subject to any disclaimer, the term of this patent is extended or adjusted under 35 U.S.C. 154(b) by 92 days.

(21) Appl. No.: 13/445,261

(22) Filed: Apr. 12, 2012

(65) Prior Publication Data

US 2012/0264531 A1 Oct. 18, 2012

Related U.S. Application Data

(60) Provisional application No. 61/474,685, filed on Apr. 12, 2011.

(51) Int. Cl.
*A63D 15/00* (2006.01)
*A63D 15/10* (2006.01)

(52) U.S. Cl.
CPC ..... *A63D 15/105* (2013.01)

(58) Field of Classification Search
CPC ..... A63D 15/00; A63D 15/006; A63D 15/08; A63D 2005/042
USPC ..... 473/1, 2, 44
See application file for complete search history.

(56) References Cited

U.S. PATENT DOCUMENTS 3,389,911 A * 6/1968 Castiglione, Jr. ..... 473/2
3,411,779 A * 11/1968 McGowan ..... 473/2
5,427,376 A * 6/1995 Cummings et al. ..... 473/201
6,656,054 B2 * 12/2003 Ulrich ..... 473/201
6,699,136 B2 * 3/2004 Kuo ..... 473/44
6,929,554 B1 * 8/2005 Wheeler, Jr. ..... 473/44
7,059,862 B2 * 6/2006 McGinley ..... 434/247
8,012,048 B1 * 9/2011 Montalvo ..... 473/459
8,241,152 B2 * 8/2012 Lima ..... 473/422

FOREIGN PATENT DOCUMENTS

GB 399087 A * 9/1933 ..... A63D 15/08
GB 1565725 A * 4/1980 ..... A63D 15/08
GB 2219517 A * 12/1989 ..... A63D 15/08
GB 2276825 A * 10/1994 ..... A63D 15/08

* cited by examiner

*Primary Examiner* — Mitra Aryanpour
(74) *Attorney, Agent, or Firm* — Dean A. Craine

(57) ABSTRACT

A cue ball deflection path training aid used by beginning pool or billiards players to help them optimally position the cue ball for the next shot. The aid includes cue ball deflection grid attached or imprinted on a cue stick's top surface. The grid includes a main neutral line, a transverse line, and two diagonally aligned lines that converge to designate a center intersection point. The two diagonal lines are aligned at approximately 60 degrees from the transverse line. The grid is oriented on the cue stick so that the main neutral line is aligned with the cue stick's longitudinal axis. In one embodiment, the grid is printed on an adhesive label attached to or near the cue stick's midline axis. During use, the player holds the cue stick so that lines of the grid are aligned with the aiming line or over the object ball path line.

15 Claims, 6 Drawing Sheets

CUE BALL DEFLECTIONS PATH TEACHING AID AND METHOD

This utility patent application is based on and claims the filing date benefit of U.S. provisional patent application, Application No. 61/474,685, filed on Apr. 12, 2011.

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention relates to training aids and more particularly, to training aids used to teach pool or billiards players to anticipate and control the deflection paths of a cue ball imparted with top spin, back spin or no spin.

2. Description of the Related Art

When making a pool or billiards shot, the cue stick must be aimed along a path that extends an imaginary 'ghost ball' located adjacent to the desired contact point on the object ball. The line extending from the center of the ghost ball, the center of the object ball, and the center of the desired cup is called the 'object ball path'.

In addition to developing aiming skills and cue stick stroke mechanics, advance Players apply spin to the cue ball to control its trajectory after impacting the object ball. to For advance players to set up the cue ball in the optimal position for next shot.

When the cue ball is struck above the center axis, topspin is created that causes the cue ball to immediately roll forward towards the object ball and continue to roll forward after impacting the object ball. If the cue ball is struck below center axis, backspin is created which causes the cue ball to initially roll backward and slide across the table towards the object ball. When the cue ball impacts the object ball, the cue ball rolls backwards along the object line. If backspin is applied to the cue ball and the distance between the cue ball and the object ball is large, the cue ball will eventually roll in a forward direction as it travels along the aim line path. When the cue ball impacts the object ball, the cue ball will travel forward only a short distance depending on the amount of backspin and the distance traveled.

When the cue ball is struck in the center, the cue ball will initially slide across the table a short distance without spin (called Stun). Eventually after a short distance, friction causes the cue ball to spin forward. When a 'stun' cue ball impacts the target ball, it ricochets off the target ball in natural direction and speed according to the laws of physics.

In addition to creating top spin and bottom spin, advance players will sometimes impart side spin, commonly known as 'English', to the cue ball. The side spin may be left side spin or right side spin and can be imparted by themselves or combined with the three spin strokes mentioned above.

Advance players are also familiar with the '90 degree angle rule' that states that with a stun shot, the cue ball and object ball will be deflected along paths 90 degrees apart. Advance players are also familiar with the '30 degree angle rule' that states that when the cue ball is spinning forward, and hits one-half of the object ball, the cue ball will be deflected 30 degrees away from the aiming line.

It is important that beginning players use a proper stance, hold and move the cue stick evenly and smoothly when making a shot. It is also important that the player hold his or her head down with their eyes focused on the contact point on the cue ball and the aiming line. Unfortunately, beginning players do not know or forget when the '90 and 30 degree angle rules' should be applied. As a result, beginning players never advance to the next skill level.

What is needed is a teaching aid that can be used by a beginning player that helps them remember the 90 and 30 degree angle rule and to help them properly align the cue stick to apply the rule during a game.

SUMMARY OF THE INVENTION

A cue ball deflection path teaching aid that includes a standard cue stick used in pool or billiards with at least one cue ball deflection path grid attached, formed or imprinted on the top surface of the cue stick. The grid is located at a location upstream from the handle area on the cue stick so that the beginning player may easily extend the cue stick forward and extend the grid over the ghost ball or object ball so the deflection lines on grid can be aligned with the anticipated paths of the cue ball after the shot. Also by placing the grid upstream from the handle, the player can easily review the deflection lines on the grid when leaning forward in a shooting stance.

The deflection grid includes a main neutral line that is longitudinally aligned with the cue stick's longitudinal axis, a transverse line that is perpendicularly aligned and actually crosses or would cross the main neutral line if extended, and at least two diagonal lines that converge towards the center, intersecting the point between the main neutral line and the transverse line crosses. In one embodiment shown, the grid is printed on the top surface of an oval shaped, flexible label designed to bend around the top surface of a cue stick. A suitable adhesive may be applied to the bottom surface of the label which holds the label in a fixed position on the cue stick. The label is aligned on the cue stick so the grid's main neutral line is aligned with the cue stick's longitudinal axis and the two diagonal lines are located above the transverse line extend towards the front tip of the cue stick.

During use, the user holds the cue stick horizontally over the table in one of two orientations depending on whether a top spin, draw spin, or a stun shot will be used. When top spin is to applied, the main neutral line is aligned over the aiming line path to the object ball. Beginner players may extend the cue stick so that the grid's center intersection point is aligned over the center point of the object ball. The grid's two diagonal lines delineate the anticipate deflection paths of a forward rolling cue ball after impacting the object ball. Simultaneously imparting side spin to the cue ball, will cause the cue ball to deviate slightly inward or slightly outward from the anticipated deflection lines.

When a backspin is desired, the player again stands behind the object ball and extends and holds the cue stick so its longitudinal axis is aligned with the object ball's path. The center intersection point on the grid is aligned over the center axis of the object ball. The player then visually determines the length of the line segment that extends from the cue ball to a point perpendicularly on the cue stick when aligned over the object ball path. The player then extends a second line segment twice the length of the first line segment laterally on the opposite side of the object ball path. The second line segment is perpendicular to the object ball path and longitudinally aligned with the first line segment. The end of the second line segment is located on the draw spin path that extends from the center axis of the object ball. An optional '2X' indicia is printed on the grid to remind the player to double the length of the first line segment to determine the location of the draw spin path.

When a stun stroke is used, the cue stick is aligned over the object ball path and the segment on the transverse line located on the side of the grid opposite the direction of the object ball path indicates the deflection path of the cue ball. If side spin is also simultaneously imparted on the cue ball, the cue ball will deviate slightly inward or slightly outward from the anticipated deflection line depending on the direction of spin imparted.

Because the deflection grid is located on the top surface of the cue stick and near the cue stick's midline axis, when the cue stick is rotated so that the grid faces upward it is readily visible to the player leaning forward and in a shooting stance. The player is able to hold his stance and move his eyes back and forth from the grid and the tip of the cue stick prior to shooting.

DESCRIPTION OF THE PREFERRED EMBODIMENT(S)

Figure 1:
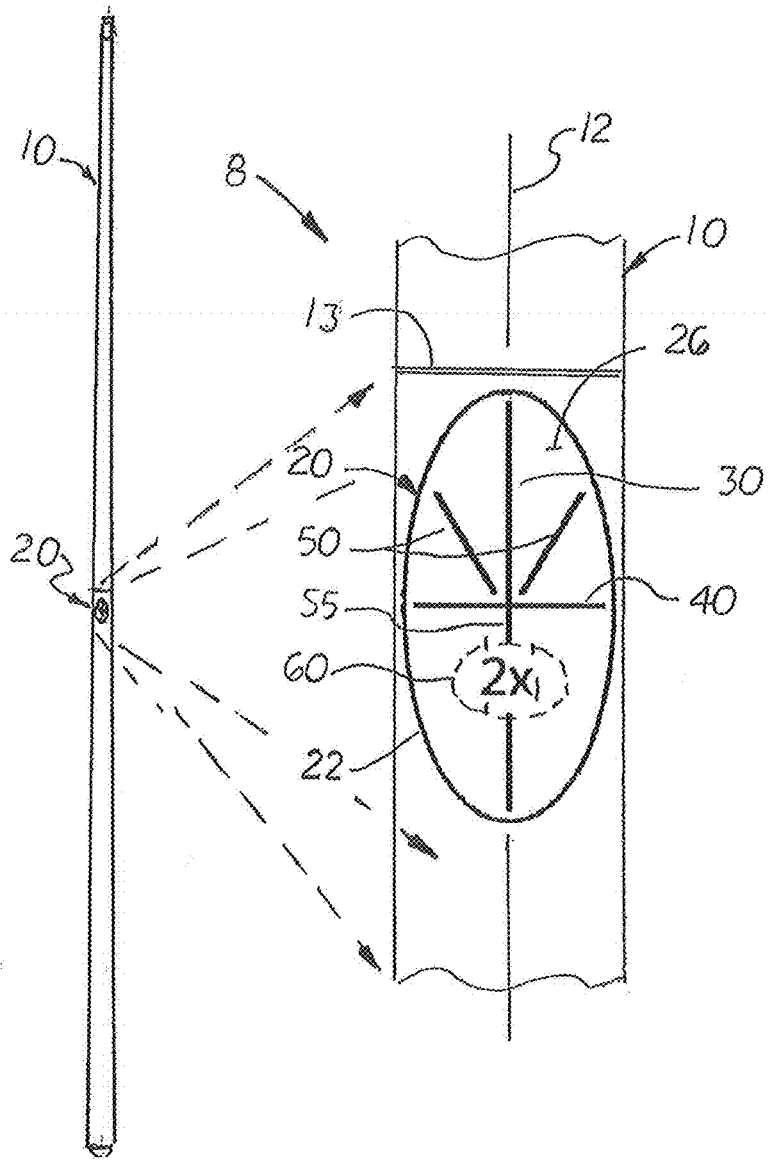
FIG. 1 is an illustration of a cue stick with the cue ball deflection path teaching aid attached to the cue stick along with an exploded view of a section of the cue stick showing the teaching aid.
Figure 2:
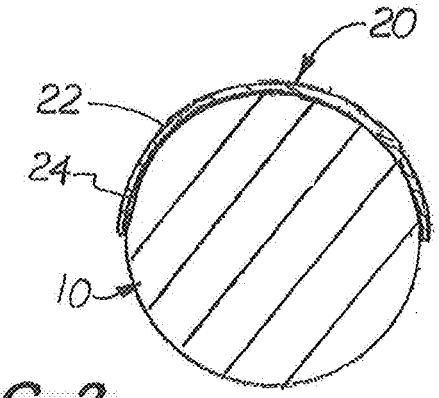
FIG. 2 is an end sectional view of the cue stick with the deflection path aid shown in FIG. 1.

Referring to the accompanying FIGS. there is shown a cue ball deflection path teaching aid 8 that includes a standard cue stick 10 used in the game of pool or billiards with at least one cue ball deflection path grid 20 formed or imprinted on the top of cue stick. The deflection path grid 20 includes a main neutral line 30 longitudinally aligned with and denotes the cue stick's longitudinal axis 12, a transverse line 40 perpendicularly aligned and actually crosses or would cross the main neutral line 30 and denotes the cue sticks transverse axis, and at least two diagonal lines 50 that denote two 60 degree diagonal axis (from the transverse axis) that converge towards the center, intersecting point 55 between the main neutral line 30 and the transverse line 40. In the embodiment shown herein, the deflection path grid 20 is printed on the top surface 26 of an oval shaped, flexible label 22 designed to bend around the top curved surface of a cue stick 10. A suitable adhesive 24 may be applied to the bottom surface of the label 22 to hold the deflection path grid 20 in a fixed position on the cue stick 10. The label 22 is aligned on the cue stick 10 so the main neutral line 30 is aligned with the cue stick's longitudinal axis 12. The label 22 is also aligned on the cue stick 10 so that the two diagonal lines 50 are located above the transverse line 40 and extend towards the end tip of the cue stick 10. During assembly, the deflection path grid 20 is location near or at the middle axis 13 of the cue stick 10 as shown in FIG. 1. The label 22 may be made of transparent material and the lines on the grid 20 may be a color that contrasts with the cue stick surface. Alternatively, the label 22 may be an opaque label with a color that matches the cue stick surface or contrasts with the cue stick.

Figure 3:
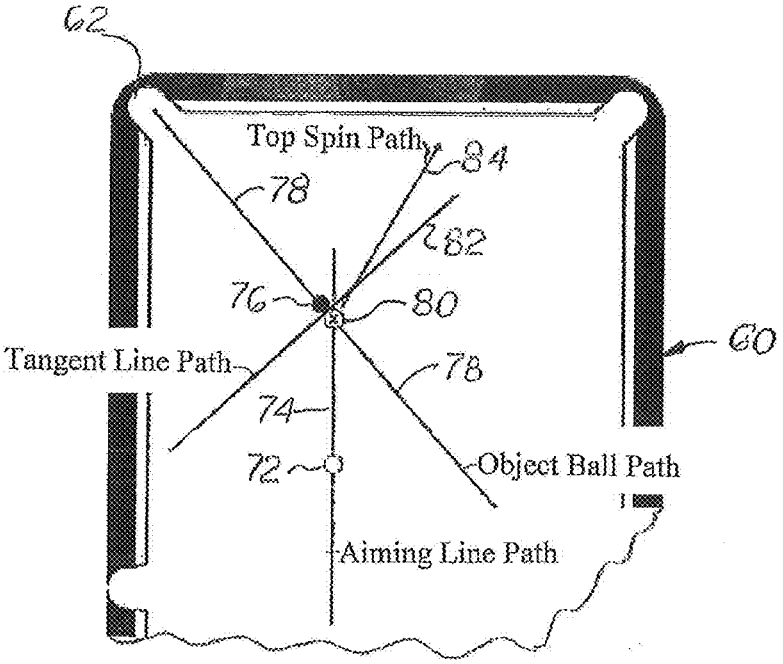
FIG. 3 is an illustration of a pool table showing an object ball, a cue ball, the aiming line path, the object ball path, the tangent line path, and the top spin path.

During use, the player holds the cue stick 10 with the end tip outward and the with the deflection path grid 20 facing upward and over the table 60. The cue stick 10 is held horizontally over the table 60 in one of two orientations depending on whether a top spin, draw spin, or a stun shot is used. FIG. 3 is an illustration of a pool table 60 showing a cue ball 72 used to hit an object ball 76 (also called a target ball) into the left corner pocket 62. Illustrated adjacent to the object ball 76 is an imaginary ghost ball 80 aligned at a tangent point on the object ball 76 aligned with an imaginary object ball path 78 that extends through the object ball 76 and into the left corner pocket 62. When the cue ball 72 is aimed over the aiming line path 72 to the location of the ghost ball 80, the object ball 76 is impacted at a location that causes it to travel along the object ball path 78 and directly into the left corner pocket 62. Also shown in FIG. 3 is a tangent line path 82 and a top spin path 84. The tangent line path 82 passes through the contact point of the ghost ball 80 and perpendicular to the object ball path 78. The top spin path 84 passes through the center axis of the imaginary ghost ball 80 and aligned approximately 30 degrees inward or downstream from the tangent line path 82.

Figure 4:
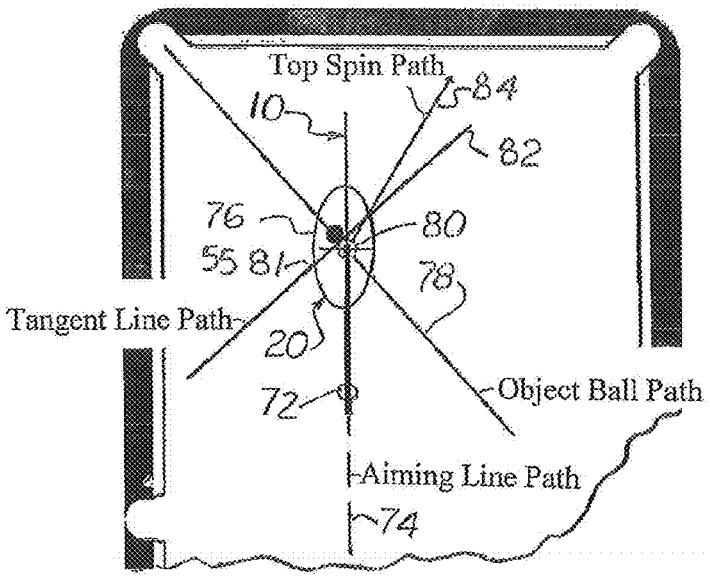
FIG. 4 is an illustration of a pool table shown in FIG. 3 with the cue stick being longitudinally aligned over the aiming line path, and the center intersection line on the grind being aligned over the center axis of the object ball.

FIG. 4 is an illustration of a pool table 60 shown in FIG. 3 with the cue stick 10 being longitudinally aligned over the aiming line path 74 with the center point of the deflection path grid 20 being aligned directly over the center axis of the ghost ball 80.

When top spin is applied, the cue stick 10 is held so that grid's main neutral line 30 is longitudinally aligned over the aiming line path 74. The center intersection point 55 of the deflection path grid 20 is aligned over the center axis 81 of the ghost ball 80. When properly aligned, the grid's two diagonal lines 50 automatically delineate the anticipated deflection paths of the rolling cue ball 72 after impacting the object ball 76. Simultaneously imparting side spin to the cue ball 72, causes the cue ball 72 to deviate slightly inward or slightly outward from the anticipated deflection line 50 on the opposite side of the aiming line path 74.

Figure 5:
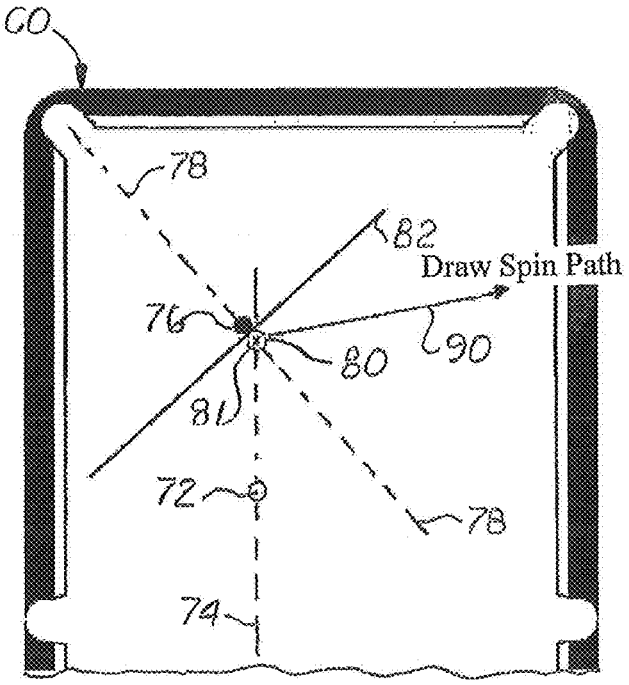
FIG. 5 is an illustration of a pool table showing a object ball, a cue ball, the aiming line path, the object ball path, the tangent line path, and the draw spin path.
Figure 6:
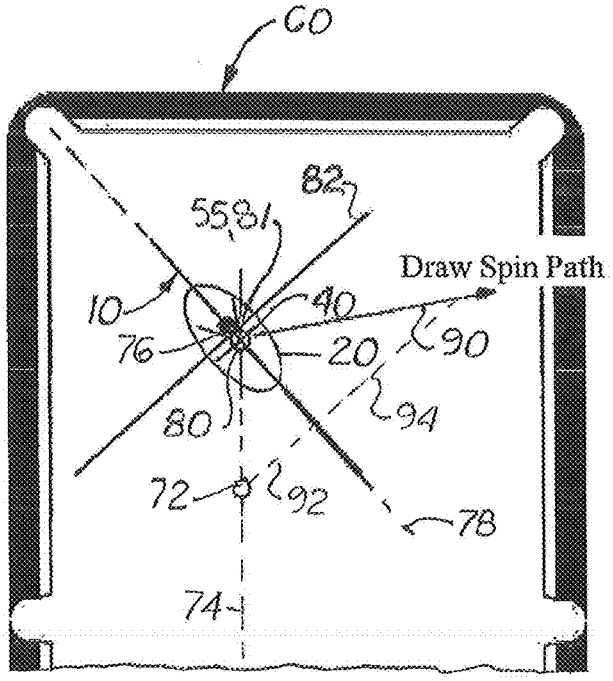
FIG. 6 is an illustration of a pool table shown in FIG. 5 with the cue stick being longitudinally aligned over the object ball path, and the center intersection line on the deflection grid being aligned over the center axis of the object ball.

FIG. 5 is an illustration of a pool table 60 showing a cue ball 72, an object ball 76, a ghost ball 80, the object ball aiming path 78, the tangent line path 82, and the draw backspin path 90. FIG. 6 is an illustration of a pool table 60 shown in FIG. 5 with the cue stick 10 being longitudinally aligned over the object ball path 78, and with the center intersection line 55 on the deflection path grid 20 being aligned over the center axis 81 of the ghost ball 80.

When a back or draw spin is desired, the player again stands behind the object ball 76 and extends and holds the cue stick 10 so that the cue stick's longitudinal axis 12 is aligned with the object ball path 78. When used by a beginning player, the cue stick 10 may be sufficiently extended forward so that the center intersection point 55 on the deflection path grid 20 is aligned over the center axis 81of the ghost ball 80. The player then visually determines the length of a first line segment 92 that extends from cue ball 72 to a point perpendicularly on the cue stick 10 when aligned over the object ball path 78. The player then extends a second line segment 94 that is twice the length of the first line segment 92 laterally on the opposite side of the object ball path 78. The second line segment 94 is perpendicular to the object ball path 78 and longitudinally aligned with the first line segment 92. The end of the second line segment 94 is located on the draw spin path 90 that extends from the center axis 81 of the ghost ball 80. On the deflection path grid 20, an optional '2X' indicia is printed on the deflection path grid 20 to remind the player to double the length of the first line segment to determine the location of the backspin path.

Figure 7:
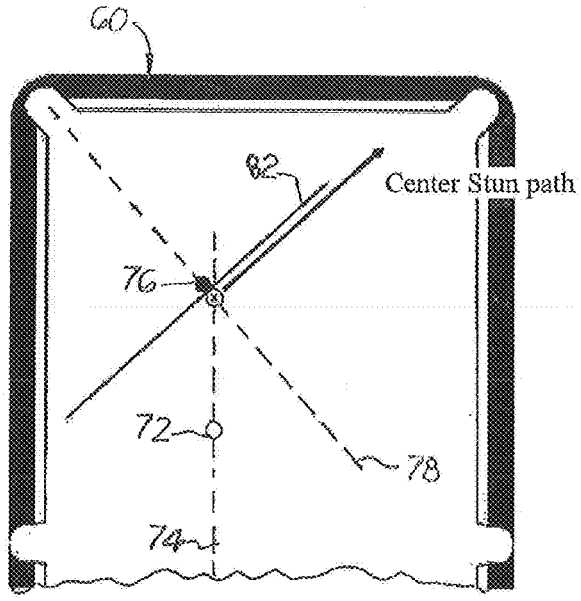
FIG. 7 is an illustration of a pool table showing an object ball, a cue ball, the aiming line path, the object ball path, the tangent line path, and the center stun path
Figure 8:
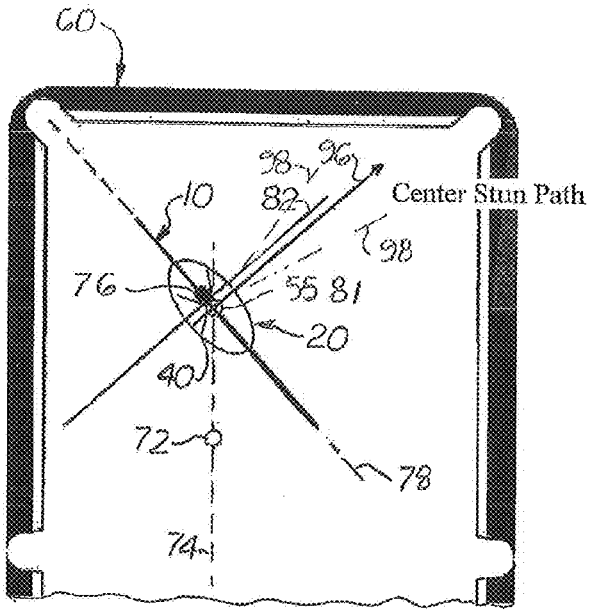
FIG. 8 is an illustration of a pool table shown in FIG. 7 with the cue stick being longitudinally aligned over the object ball path, and the center intersection line on the deflection grid being aligned over the center axis of the object ball.

FIG. 7 is an illustration of a pool table 60 showing an object ball 76, a cue ball 72, the aiming line path 78, the object ball path 74, the tangent line path 82, and the center stun path 96. FIG. 8 is an illustration of a pool table 60 shown in FIG. 7 with the cue stick 10 being longitudinally aligned over the object ball path 74, and the center intersection line 55 on the deflection path grid 20 being aligned over the center axis 81 of the ghost ball 80.

When a stun stroke is used, the cue stick 10 is aligned over the object ball path 78 and the segment on the transverse line 82 located on the side of the grid 20 opposite the direction of the object ball path 78 indicates the stun deflection path 96 of the cue ball 72. If side spin is also simultaneously imparted on the cue ball 72, the cue ball 72 will deviate slightly inward or slightly outward (see lines 98 and 98') from the anticipated stun deflection line 96 depending on the direction of spin imparted.

Figure 9:
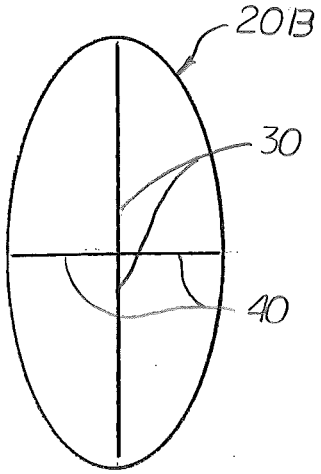
FIGS. 9-15 are illustrations of seven different embodiments of the cue ball path indicator.
Figure 10:
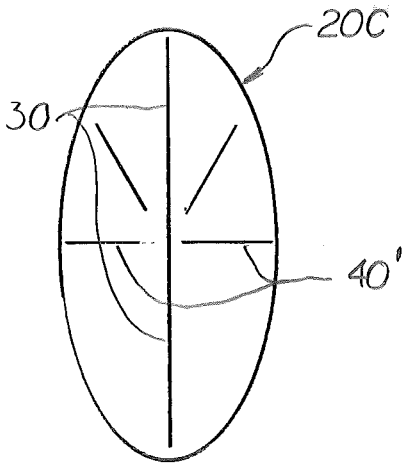
Figure 11:
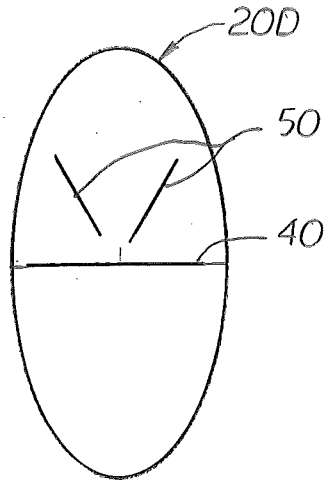
Figure 12:
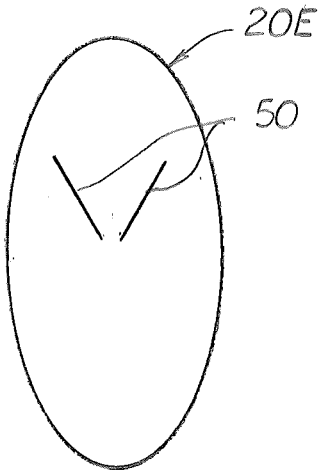

It should be understood that the main neutral line 50, transverse line 40, the two diagonal lines 50 and the center point 50 may be depicted in different ways. Also, in some instances, only the main neutral line 50 and transverse line 40 are used (see grid 20B in FIG. 9). FIG. 10 shows alternative grid 20C with a continuous main neutral lines 50, a segmented transverse line 40' and two diagonal lines 50. In an alternative grid, two diagonal lines 30, only the transverse line 40 and the two diagonal lines are used (See grid 20E in FIG. 11), or only the two diagonal lines 50 are used (See grid 20E in FIG. 12).

Figure 13:
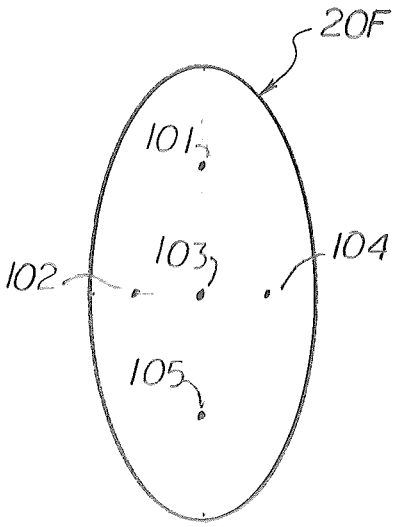
Figure 14:
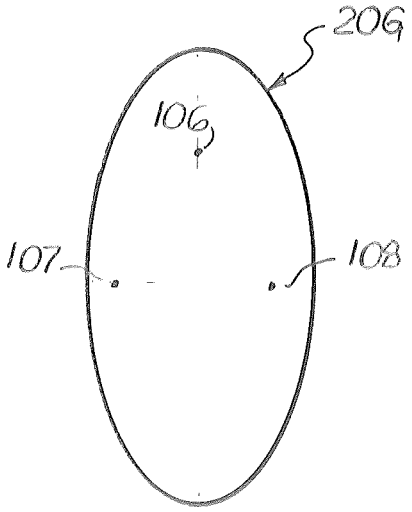
Figure 15:
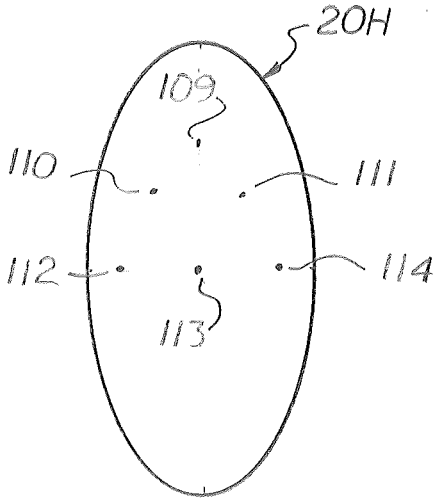

FIGS. 13-15 show alternative grids showing the five dots 101-105 arranged in a diamond shape (grid 20F) configuration used to depict the main neutral line and the transverse line; three dots 106-108 arranged in a triangle (grid 20G) confused to depict the main neutral line and the transverse line, and six dots 109-114 arranged in a triangle depicting the main neutral line, and the transverse line, and the two diagonal lines.

Using the above aid a method for teaching the deflection paths of a cue ball with top spin, backspin and no spin, comprising the following steps:

a. selecting a cue stick with a cue ball path deflection aid attached or mounted thereon, said aid includes a grid made of a main neutral line, a perpendicular transverse line, and two diagonal lines located on opposite sides of said main neutral line, said main neutral line and said transverse line forming a center intersection point, said diagonal lines extending upward from said center point 30 degrees above said horizontal line;

b. determining whether the cue ball to be shot, shall have top spin, backspin or no spin;

c. holding said cue stick with an end tip pointing towards said cue ball and said deflection aid is facing upward and visible when in a shooting stance, if a top spin shot is desired, then aligning said cue stick over the cue ball path and reviewing the orientation of said diagonal line on the side opposite an object ball to determine the deflection path of said cue ball, if a back spin shot is desired, then aligning said cue stick over said object ball path and determining the length of a first line segment which extends perpendicular from said object ball path to said cue ball and extending said the first line segment across said object ball path and determining a point along the extended first line segment that is twice the length of the first line segment, then extending a line from said object ball to the point along an extended first line segment to designated the deflection line of said cue ball with backspin, and no spin shot is desired, then aligning said cue stick over said object ball path and then using said transverse line to designate the deflection path of said cue ball; and, d. executing a shot as determined in steps b and c and observing the deflection path of said cue ball.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A cue ball deflection path teaching aid, comprising;

a. a cue stick having a longitudinal axis, a midline axis and a curved top surface; and, b. a cue ball path grid positioned on said curved top surface near said midline axis of said cue stick, said cue ball path grid including a main neutral line, a perpendicular transverse line, and two diagonal lines extending on opposite sides of said main neutral line, said main neutral line being aligned with said longitudinal axis of said cue stick and said transverse line crossing said main neutral line and creating a center intersection point, said diagonal lines extending from said center point 60 degrees above said transverse line.

2. The teaching aid as recited in claim 1, wherein said cue ball path grid is printed on a label affixed to said cue stick.

3. The teaching aid as recited in claim 2, further including all adhesive for attaching said label to said cue stick.

4. The teaching aid as recited in claim 2, wherein said label is made of transparent material thereby enabling a section of said cue stick to be visible under said label, said main neutral line, said transverse line, and said diagonal lines being a color or colors that contrast with the color of said cue stick.

5. The teaching aid as recited in claim 3, wherein said label is oval in shape with an elongated axis aligned with said longitudinal axis of said cue stick.

6. A cue ball deflection path teaching aid, comprising;

a. a cue stick with a longitudinal axis and a curved top surface; and, b. a cue ball path grid positioned on said curved top surface on said cue stick, said cue ball path grid including indicia defining a main neutral line, a transverse line perpendicular to said main neutral line and an intersecting point, said indicia further defining two forward extending diagonal lines aligned approximately 60 degrees from said transverse line, said diagonal lines converge and are aligned with said intersecting point between said main neutral line and said transverse line, and wherein said main neutral line corresponds with said longitudinal axis of said cue stick.

7. The teaching aid as recited in claim 6 wherein said main neutral line on said cue ball path grid is denoted by at least two dots.

8. The teaching aid as recited in claim 6 wherein said transverse line on said cue ball path grid is denoted by at least two dots or dashes.

9. The teaching aid as recited in claim 6 wherein each said diagonal lines on said cue ball path grid is denoted by at least two dots or dashes.

10. A method for teaching a user the deflection paths of a cue ball having a top spin, a backspin or having no spin, said method comprises the steps of:

a. selecting a cue stick having a longitudinal axis and a curved top surface;

b. attaching or mounting a cue ball path deflection aid on said curved top surface of said cue stick, said aid being formed of a grid comprising a main neutral line, a perpendicular transverse line, and two diagonal lines located on opposite sides of said main neutral line, said main neutral line and said transverse line forming a center intersection point and said diagonal lines extending forward from said center intersection point 30 degrees above said transverse line;

c. taking a shooting stance said user holding said cue stick with an end tip pointing towards said cue ball, said deflecting aid facing forward and visible when said user is in said shooting stance;

d. selecting a spin type for said ball shot;

for a top spin shot, aligning said cue stick over the cue ball path and observing the orientation of said diagonal lines on the side opposite the object ball in order to determine the deflection path of said cue ball, for a back spin shot, aligning said cue stick over an object ball path, determining a length of a first line segment which extends perpendicular from said object ball path to said cue ball and extending the first line across said object ball path and determining a point along an extended first line segment which is twice the length of a first line segment, extending a line from said object ball to a point along the extended first line segment in order to determine the deflection path of said cue ball, and for a no spin shot, aligning said cue stick over said object ball path, using said transverse line to determine the deflection path of said cue ball; and, e. executing a shot as determined in step d and observing the deflection path of said cue ball.

11. A cue ball deflection path teaching aid, comprising;

a. a cue stick with a longitudinal axis, a transverse axis, and a curved top surface; and, b. a cue ball path grid longitudinally aligned on said curved top surface on said cue stick, said cue ball path grid including a visual indicia denoting a transverse line parallel to said transverse axis and perpendicular to said longitudinal axis of said cue stick and two diverging diagonal lines that begin at or visually extended forward from a visual or non visual intersection point formed between said longitudinal axis and said transverse axis, each said diagonal line extends forward on said curved surface on opposite sides of said longitudinal axis approximately 30 degrees.

12. The teaching aid as recited in claim 11 wherein said grid further includes a visual main neutral line aligned with said longitudinal axis of said cue stick.

13. The teaching aid as recited in claim 12 wherein said main neutral line is denoted by at least two dots.

14. The teaching aid as recited in claim 11 wherein each said diagonal lines on said cue ball path grid is denoted by at least two dots or dashes.

15. The teaching aid as recited in claim 11 wherein said cue ball path grid is printed on a label attached to said curved top surface of said cue stick.

* * * * *